US006650354B2

(12) United States Patent
Morizono et al.

(10) Patent No.: US 6,650,354 B2
(45) Date of Patent: Nov. 18, 2003

(54) IMAGE RECORDER HAVING DIAGNOSTIC CAPABILITY

(75) Inventors: Osamu Morizono, Kyoto (JP); Yoshimi Hashimoto, Kyoto (JP)

(73) Assignee: Dainippon Screen Mfg., Co., Ltd., Kyoto (JP)

( * ) Notice: Subject to any disclaimer, the term of this patent is extended or adjusted under 35 U.S.C. 154(b) by 30 days.

(21) Appl. No.: 09/984,767

(22) Filed: Oct. 31, 2001

(65) Prior Publication Data

US 2002/0051055 A1 May 2, 2002

(30) Foreign Application Priority Data

Oct. 31, 2000 (JP) ..... P2000-332621

(51) Int. Cl.[7] ..... B41J 2/47
(52) U.S. Cl. ..... 347/255; 347/239
(58) Field of Search ..... 347/239, 240, 347/251, 255, 135; 359/231; 372/38.02

(56) References Cited

U.S. PATENT DOCUMENTS 5,163,063 A * 11/1992 Yoshikawa et al. ..... 372/38.02
6,025,859 A * 2/2000 Ide et al. ..... 347/135
6,147,789 A * 11/2000 Gelbart ..... 359/231

FOREIGN PATENT DOCUMENTS

JP 2-3350 * 1/1990 ..... B41J/2/44
JP 8-90831 4/1996
JP 9-230280 9/1997
JP 2000-168136 6/2000

* cited by examiner

*Primary Examiner*—Hai Pham
(74) *Attorney, Agent, or Firm*—McDermott, Will & Emery

(57) ABSTRACT

There is provided an image recorder which allows easy malfunction detection in a light modulator and can previously prevent the occurrence of fogging of a photosensitive material, a fire, or the like. A recording head (12) in the image recorder includes a laser light source (21) for emitting a laser beam, a light modulator (24) for modulating a laser beam, an illumination optical system (23) for irradiating the light modulator (24) with a laser beam emitted from the laser light source (21), an imaging optical system (26) for focusing signal light from the light modulator (24) onto a recording medium (11) for image formation, a photodetector (27) for detecting non-signal light from the light modulator (24), a controller (28) for detecting a malfunction in the light modulator (24) on the basis of output from the photodetector (27), and a light shielding mechanism (22) for, when the controller (28) detects a malfunction in the light modulator (24), cutting off an optical path between the laser light source (21) and the light modulator (24).

18 Claims, 11 Drawing Sheets

IMAGE RECORDER HAVING DIAGNOSTIC CAPABILITY

BACKGROUND OF THE INVENTION

1. Field of the Invention

The present invention relates to image recorders, in particular to an image recorder with a laser source, a light modulator, an illumination optical system, and an imaging optical system.

2. Description of the Background Art

Light modulators for use in such an image recorder include, for example, a grating light valve, a digital micromirror device, and a PLZT (lead lanthanum zirconate titanate) light modulator.

The grating light valve is a light modulator (light valve) which modulates a light beam through the use of diffraction caused by several thousands of horizontally aligned reflection plates (ribbons) being moved by electric force. The Grating Light Valve is also called "GLV", being developed by the U.S.-based Silicon Light Machines (Sunnyvale, Calif.) (the Grating Light Valve is a trademark of the Silicon Light Machines).

The digital micromirror device is a light modulator, also called the "DMD (trademarked by Texas-Instruments)," which modulates a light beam by electrically tilting several hundreds or several thousands of tilting micromirrors to change the direction of light beams reflecting from the micromirrors.

The PLZT (lead lanthanum zirconate titanate) light modulator is a light modulator which has the function of rotating the polarization state of a laser beam in accordance with a voltage applied thereto and is used in combination with a polarizer or the like.

The conventional image recorders using such light modulators have a problem of not being able to detect a malfunction in a light modulator caused by a breakdown of the light modulator itself or of a driver, etc. of the light modulator.

Especially when the image recorders use, as signal light, outgoing light from a light modulator with no drive signal applied, a laser beam will be kept applied onto the image recording surface even at the occurrence of a malfunction in the light modulator.

For example, when image recording is performed with the application of a laser beam onto a recording medium such as a thermal (heat-sensitive) material, a high-power laser light source such as a bar laser (broad-area semiconductor laser) is used. The use of such a high-power laser light source yields an extremely high power density of a laser beam on the image recording surface; therefore, if the laser beam is kept applied onto the image recording surface, the recording medium might burst into flames, causing a fire.

SUMMARY OF THE INVENTION

The present invention is directed to an image recorder for modulating a laser beam emitted from a laser light source by a light modulator and then focusing the laser beam onto an image recording surface to form an image.

According to a aspect of the present invention, the image recorder comprises: a laser light source for emitting a laser beam; a light modulator for modulating a laser beam; an illumination optical system for irradiating the light modulator with a laser beam emitted from the laser light source; an imaging optical system for focusing signal light onto the image recording surface to form an image, the signal light being outgoing light from the light modulator with no drive signal applied to the light modulator; a photodetector for detecting non-signal light which is outgoing light from the light modulator with a drive signal applied to the light modulator; and a detector for detecting a malfunction in the light modulator on the basis of output from the photodetector.

This image recorder can detect a malfunction in the light modulator with certainty. This prevents the occurrence of fogging of a photosensitive material, a fire, or the like in the recording medium which is caused by the laser beam being kept applied onto the image recording surface.

According to another aspect of the present invention, the image recorder further comprises a light shielding mechanism for, when the detector detects a malfunction in the light modulator, cutting off an optical path between the laser light source and the image recording surface under the control of the controller.

Since the optical path between the laser light source and the image recording surface is cut off when the detector detects a malfunction in the light modulator, the occurrence of fogging of a photosensitive material, a fire, or the like in the recording medium can be prevented.

According to still another aspect of the present invention, the image recorder further comprises a stop mechanism for, when the detector detects a malfunction in the light modulator, turning off the laser light source under the control of the controller.

Since the laser light source is turned off when the detector detects a malfunction in the light modulator, the occurrence of fogging of a photosensitive material, a fire, or the like in the recording medium can be prevented.

An object of the present invention is, therefore, to provide an image recorder which allows easy malfunction detection in the light modulator and can prevent the occurrence of a fire or the like.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
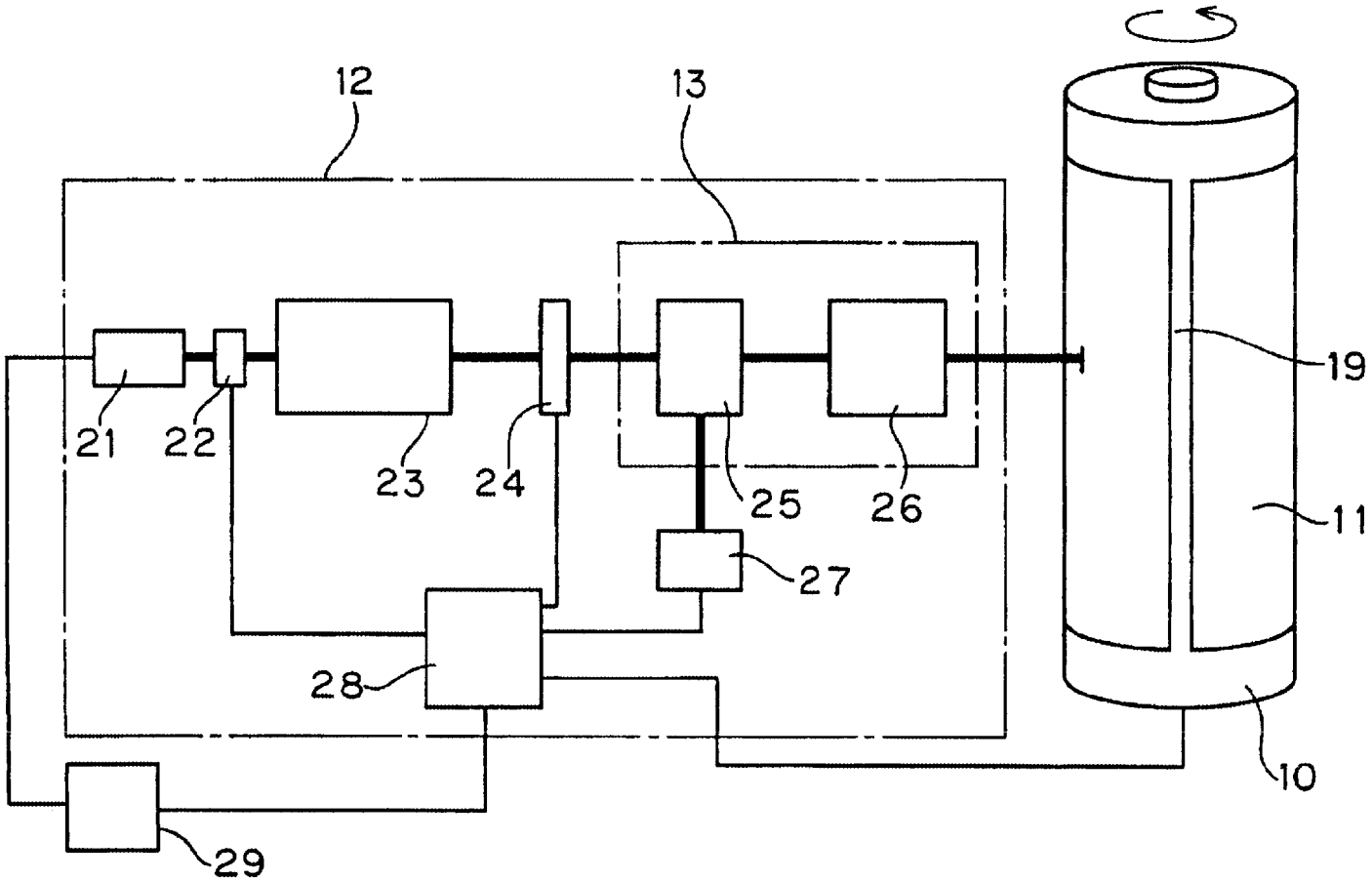
FIG. 1 is a schematic view of an image recorder according to the present invention.

In the following description, preferred embodiments of the present invention will be set forth with reference to the drawings. FIG. 1 is a schematic view of an image recorder according to the present invention.

This image recorder comprises a recording drum 10 with a recording medium 11 such as a thermal material wound around the perimeter of the recording drum 10, and a recording head 12 for emitting a laser beam modulated in accordance with an image signal. In the image recorder, the recording drum 10 rotates about its axis and the recording head 12 moves in the direction of the axis of the recording drum 10, whereby an image corresponding to an image signal is recorded on the recording medium 11.

The recording head 12 comprises a laser light source 21 for emitting a laser beam, a light modulator 24 for modulating a laser beam, an illumination optical system 23 for irradiating the light modulator 24 with a laser beam emitted from the laser light source 21, an imaging optical system 26 for focusing signal light from the light modulator 24 onto the recording medium 11 for image formation, a photodetector 27 for detecting light, a non-signal light extraction mechanism 25 for extracting and leading non-signal light from the light modulator 24 to the photodetector 27, and a controller 28 for detecting a malfunction in the light modulator 24 on the basis of output from the photodetector 27.

The non-signal light extraction mechanism 25 is contained in a lens barrel 13 for the imaging optical system 26, while being supported and secured thereby.

The controller 28 is connected to a light shielding mechanism 22 located between the laser light source 21 and the illumination optical system 23. The light shielding mechanism 22 is for cutting off an optical path between the laser light source 21 and the light modulator 24 when the controller 28 detects a malfunction in the light modulator 24. The controller 28 is also connected to a power supply 29 for the laser light source 21, the light modulator 24, and the photodetector 27. Further, a drive motor (not shown) for the recording drum 10 is connected to the controller 28.

In FIG. 1, thick solid lines show an optical path for laser beams, and thin solid lines show a signal line.

Figure 2:
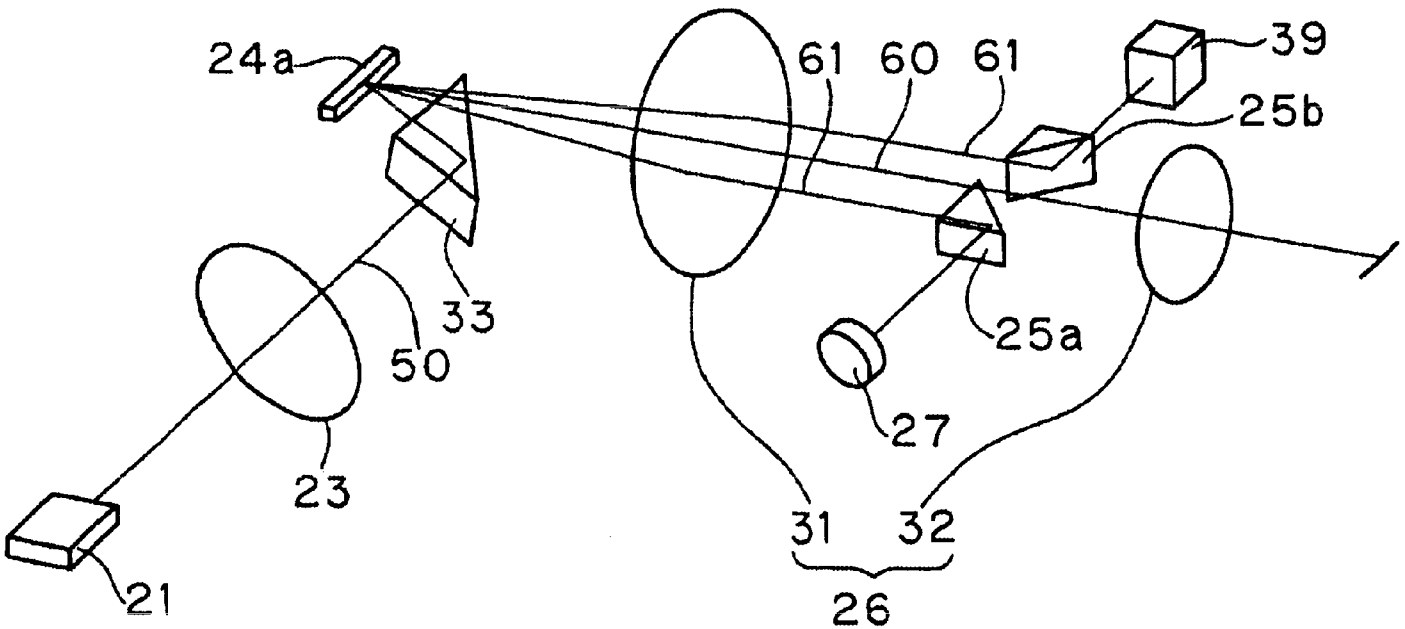
FIG. 2 is a perspective view illustrating an optical configuration of a recording head according to a first preferred embodiment.

Next, an optical configuration of the recording head 12 will be described. FIG. 2 is a perspective view illustrating an optical configuration of the recording head 12 according to a first preferred embodiment. The aforementioned light shielding mechanism 22 is not shown in FIG. 2. A total reflection prism 33 shown in FIG. 2 is omitted in FIG. 1.

The recording head 12 according to the first preferred embodiment uses a grating light valve 24*a* as the aforementioned light modulator 24.

Figure 3A:
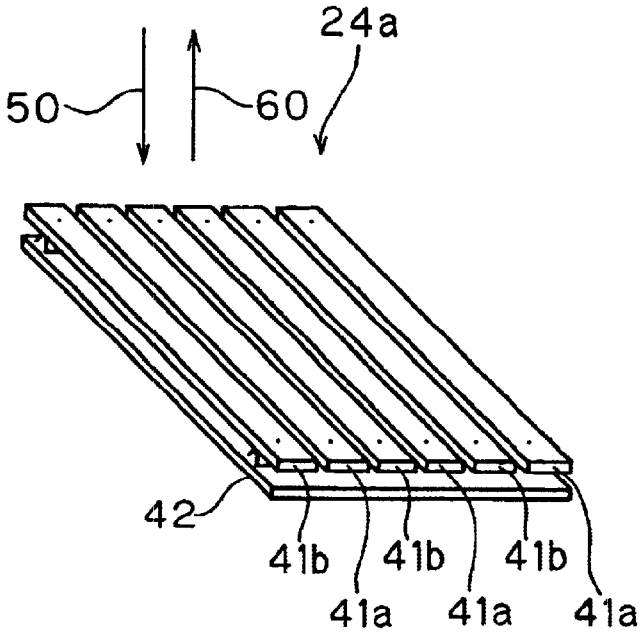
FIGS. 3A and 3B are perspective views illustrating a principal portion of a grating light valve.
Figure 3B:
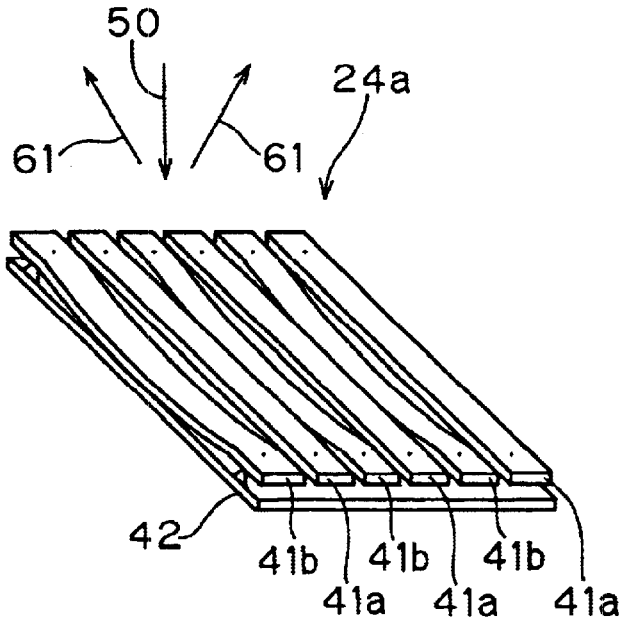

FIGS. 3A and 3B are perspective views illustrating a principal portion of the grating light valve 24*a*, wherein only an area of one pixel in the grating light valve 24*a* is shown.

The grating light valve 24*a* has a configuration in which several thousands of reflection plates 41 (41*a*, 41*b*) are horizontally aligned on a support base 42. These reflection plates 41 include alternate fixed reflection plates 41*a* and movable reflection plates 41*b* (both of which are generically referred to as the "reflection plates 41").

The fixed reflection plates 41*a* have their surfaces fixed in position. The movable reflection plates 41*b*, on the other hand, have an effective movable area in the surface which descends in response to an applied drive signal. Six reflection plates 41 including three fixed reflection plates 41*a* and three movable reflection plates 41*b* constitute a single element for use in modulating a single laser beam. That is, three movable reflection plates 41*b* constituting the same element move in synchronization with one another.

In the grating light valve 24*a*, with no drive signal applied to the movable reflection plates 41*b*, the surfaces of the fixed reflection plates 41*a* and the movable reflection plates 41*b* are in the same plane as shown in FIG. 3A. With application of a drive signal to the movable reflection plates 41*b* in this condition, the movable reflection plates 41*b* are lowered by an amount equal to a one-quarter wavelength of the laser beam as shown in FIG. 3B, which brings about the same effect as can be achieved by using a reflecting diffraction grating.

From the above, the grating light valve 24*a*, with no drive signal applied to the movable reflection plates 41*b*, reflects zero-order diffracted light 60 of incident light 50 as shown in FIG. 3A. Under this condition, the grating light valve 24*a* serves as a regular reflecting mirror. With application of a drive signal to the movable reflection plates 41*b*, on the other hand, two first-order diffracted lights 61 at different angles and higher-order diffracted light of the incident light 50 are reflected as shown in FIG. 3B. Under this condition, the grating light valve 24*a* serves as a reflecting diffraction grating.

Therefore, application of a laser beam to rectangular areas in the surfaces of the reflection plates 41 in the grating light valve 24*a* (this area is included in the effective movable area in the movable reflection plates 41*b*) produces several hundreds of laser beams which can be modulated independently. By using the zero-order diffracted light 60 as signal light and the first-order diffracted lights 61 as non-signal lights, the grating light valve 24*a* can be used as a lilt modulator for image recording.

The reason why the grating light valve 24*a* uses the zero-order diffracted light 60 as signal light and the first-order diffracted lights 61 as non-signal lights is as follows.

The diffraction efficiency of the first-order diffracted lights 61 is only about 40% and thus it is not suitable for use in image recorders which require a high light density. The efficiency of light utilization can be improved by approximately 80% through the use of the first-order diffracted lights 61 at different angles, but in this case, not only does the focal depth on the image surface side become smaller because of increasing numerical aperture, but the lens design for the imaging optical system 26 also becomes difficult. For these reasons, the grating light valve 24*a* uses the zero-order diffracted light 60 as signal light.

In the image recorder with the aforementioned configuration, a laser beam emitted from the laser light source 21 is applied onto the grating light valve 24*a* through the illumination optical system 23 and the total reflection prism 33. This laser beam is made into several hundreds of independently modulated signal lights 60 by the grating light valve 24*a* and then focused through the imaging optical system 26 onto the recording medium 11 to form an image for image recording.

The aforementioned grating light valve 24*a* may be also called "GLV", being developed by the U.S.-based Silicon Light Machines (the Grating Light Valve is a trademark of the Silicon Light Machines).

Referring back to FIG. 2, the recording head 12 according to the first preferred embodiment uses, as the above imaging optical system 26, a pair of lenses 31 and 32 which constitute a double-sided telecentric optical system, and as the above non-signal light extraction mechanism 25, a pair of total reflection prisms 25*a* and 25*b* located between the pair of lenses 31 and 32.

Figure 4:
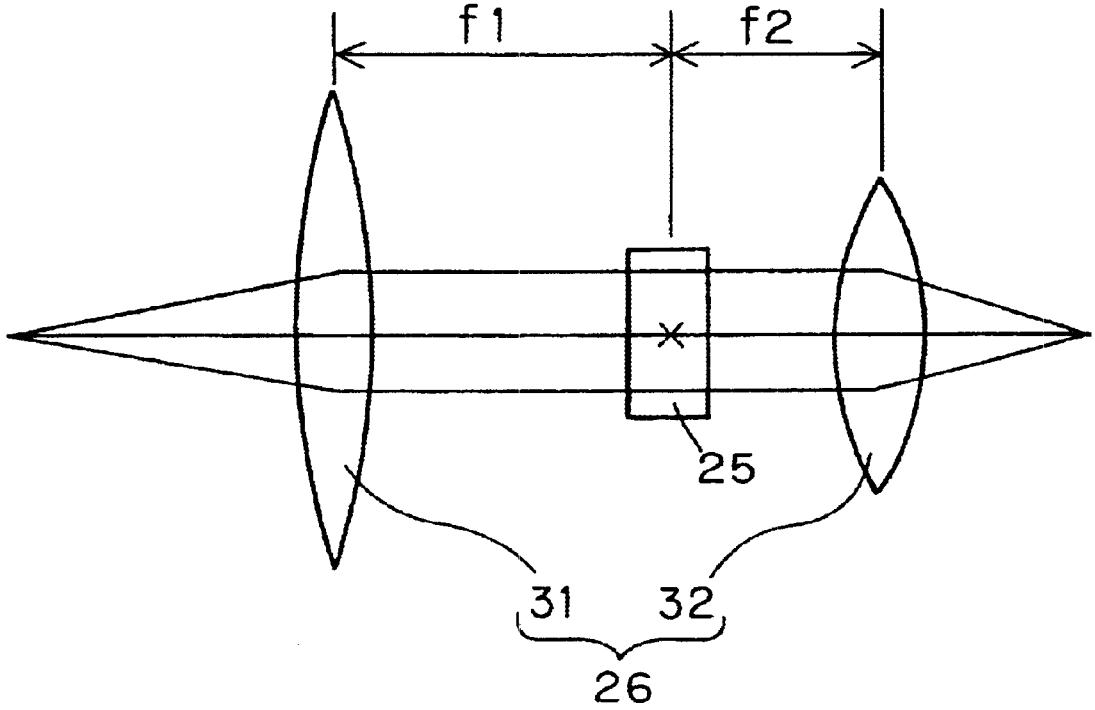
FIG. 4 is a side view illustrating an arrangement of a pair of lenses constituting an imaging optical systems and a pair of total reflection prisms constituting a non-signal light extraction mechanism.

FIG. 4 is a side view illustrating an arrangement of the pair of lenses 31 and 32 constituting the imaging optical system 26, and the pair of total reflection prisms 25*a* and 25*b* constituting the non-signal light extraction mechanism 25.

The pair of lenses 31 and 32 constituting the imaging optical system 26 are spaced apart from each other by a distance equal to a sum (f1+f2) of focal lengths f1 and f2 of the lenses 31 and 32, respectively. The pair of total reflection prisms 25*a* and 25*b* are spaced apart from the lens 31 by the distance f1 and from the lens 32 by the distance f2, i.e., they are located at the position of an aperture stop for the imaging optical system 26 to extract and lead the first-order diffracted lights 61 as non-signal lights to the outside of the lens barrel 13.

More specifically, as schematically illustrated in FIG. 2, at the position of the aperture stop for he imaging optical system 26, the optical path for the zero-order diffracted light 60 as signal light is completely separated from the optical paths for the first-order diffracted lights 61 as non-signal lights. Thus, arranging the pair of total reflection prisms 25*a* and 25*b* in positions where the first-order diffracted lights 61 at different angles pass through the aperture stop allows effective extraction of the first-order diffracted lights 61 as non-signal lights.

At the position of the aperture stop for the imaging optical system 26, there may be another high-order diffracted light, besides the zero-order diffracted light 60 as signal light and the first-order diffracted lights 61 as non-signal lights. However, the quantity of such a high-order diffracted light is so small as to be negligible.

Of the first-order diffracted lights 61 at different angles, the one reflected by the total reflection prism 25*a* enters the photodetector 27 located outside the lens barrel 13, the photodetector 27 measuring the quantity of the light. The other first-order diffracted light reflected by the total reflection prism 25*b* enters an absorber 39 located outside the lens barrel 13, the absorber 39 absorbing the light and dissipating heat.

The photodetector 27 may be a highly sensitive light sensor such as a silicon photodetector. Or it may be a calorimeter or the like which detects light quantity through temperature measurements on a light absorber.

As described later, the first-order diffracted lights 61 are small in quantity during an initial operation while being large during a steady state operation. In using the aforementioned light sensor such as a silicon photodetector as the photodetector 27, the quantity of the first-order diffracted light 61 entering the photodetector 27 should be controlled through the use of an ND filter or diffusion plate, during the steady state operation.

For a similar reason, it is also possible to use a light sensor such as a silicon photodetector as the photodetector 27 and to substitute a photodetector with a calorimeter for the absorber 39, so that the quantity of the first-order diffracted lights 61 is detected by the photodetector 27 or light sensor such as a silicon photodetector during the initial operation and by a photodetector with a calorimeter during the steady state operation.

Figure 5:
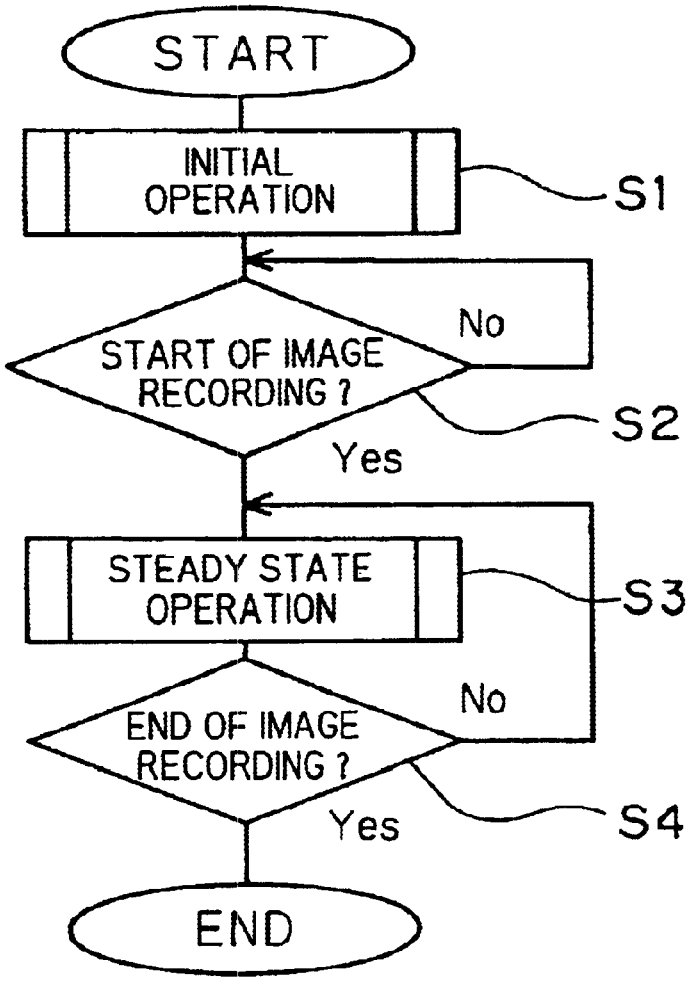
FIG. 5 is a flow chart illustrating a detecting operation for detection of malfunctions in a light modulator.
Figure 6:
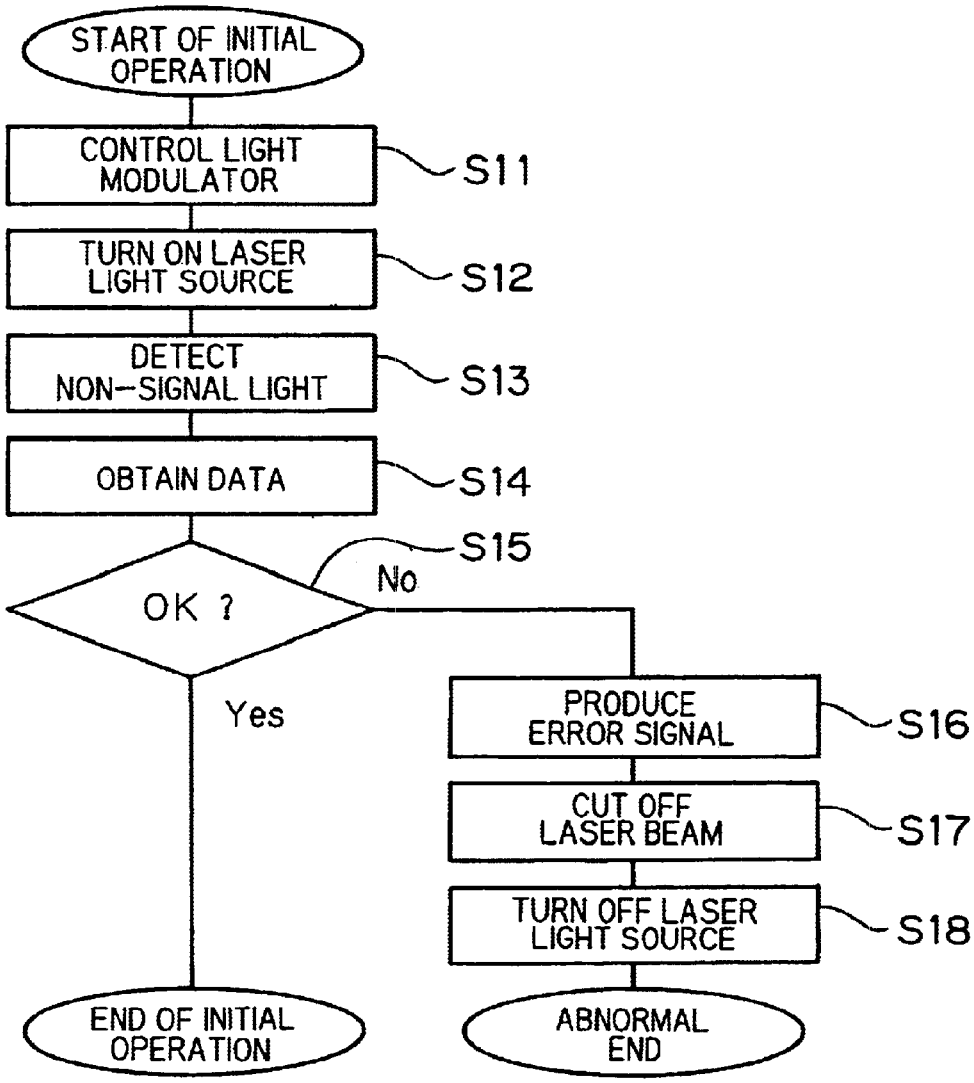
FIG. 6 is a flow chart of an initial operation.
Figure 7:
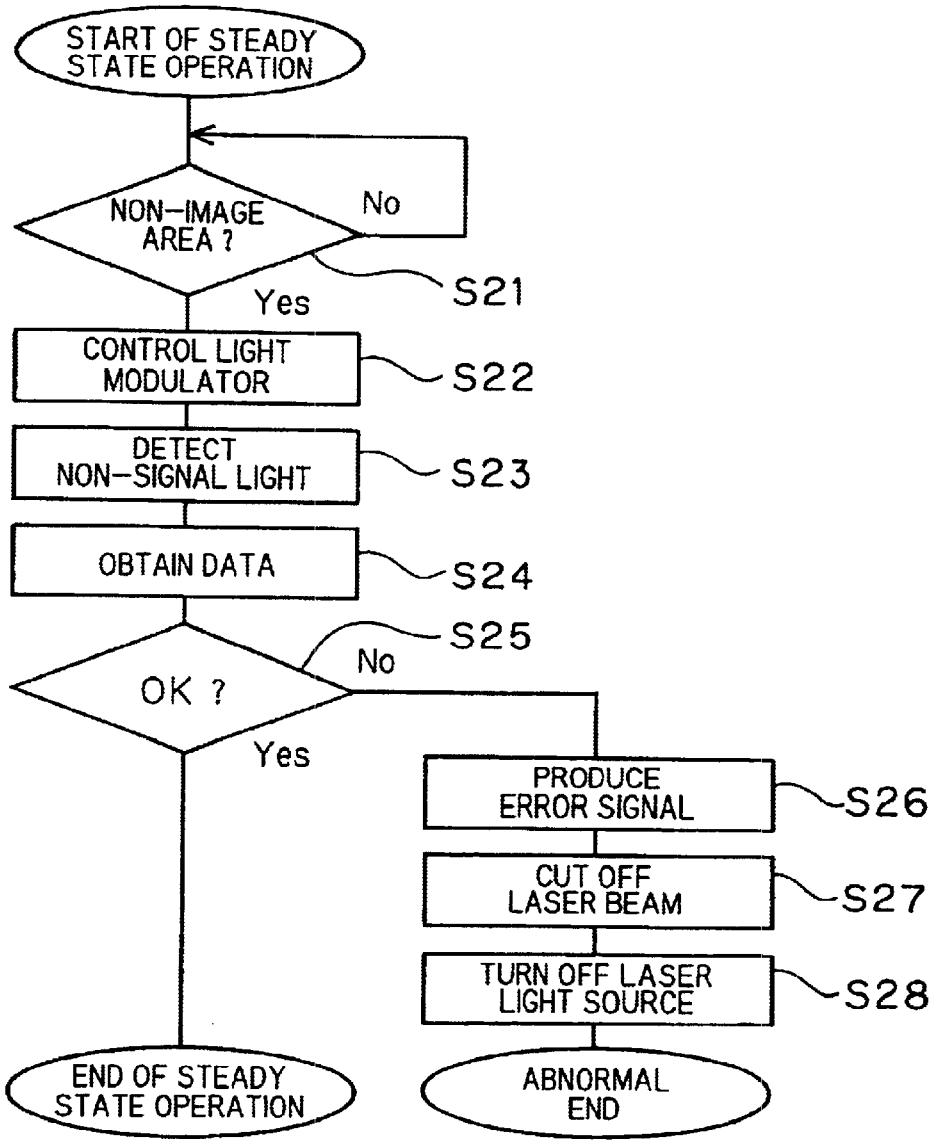
FIG. 7 is a flow chart of a steady state operation.

Next, we will describe a detecting operation for malfunction detection in the grating light valve 24*a* as the light modulator 24 in the image recorder with the aforementioned configuration. FIG. 5 is a flowchart illustrating the detecting operation for detection of malfunctions in the grating light valve 24*a* as the light modulator 24 in the image recorder according to the present invention. FIG. 6 is a flowchart of the initial operation as a subroutine, and FIG. 7 is a flowchart of the steady state operation as another subroutine.

The image recorder according to the present invention, in order to detect a malfunction in the grating light valve 24*a* as the light modulator 24, independently performs the initial operation precedent to image recording and the steady state operation during image recording. The malfunction detection may be carried out during at least either the initial operation or the steady state operation.

As illustrated in FIG. 5, prior to the start of image recording, the initial operation is carried out (step S1). The initial operation, as described later, is executed upon turn-on of the laser light source 21 by emitting a low-power laser beam from the laser light source 21.

If the initial operation completes successfully, the image recorder enables the laser light source 21 to emit a normal-power laser beam ad waits for the start of image recording (step S2). When the image recording starts, the image recorder performs the steady state operation as described later (step S3). This steady state operation is repeated until the image recording operation is complete (step S4).

The aforementioned initial operation proceeds according to the process steps illustrated in FIG. 6.

At first, control is exerted on the grating light valve 24*a* as the light modulator 24 (step S11) and the laser light source 21 is turned on in low power mode (step S12). Turning on the laser light source 21 in low power mode during the initial operation is because, if the grating light valve 24*a* is already malfunctioning at turn-on of the laser light source 21, turning on the laser light source 21 in normal power mode can cause, for example, fogging of a photosensitive material or a fire in the recording medium 11.

Next, non-signal light is detected (step S13). This is performed such that the photodetector 27 detects the quantity of the first-order diffracted light 61 as non-signal light which has been reflected by the total reflection prism 25*a* shown in FIG. 2 and entered the photodetector 27 located outside the lens barrel 13.

The controller 28 obtains this light quantity data (step S14) and compares it with a preset value (step S15). When the light quantity data is equal to or greater than the preset value, the grating light valve 24*a* is considered to be operating properly and he initial operation is completed.

When the light quantity data is smaller than the preset value, on the other hand, the controller 28 judges that a malfunction occurs in the grating light valve 24*a*. Thus, an error signal is produced (step S16) and the light shielding mechanism 22 shown in FIG. 1 is activated to cut off the optical path between the laser light source 21 and the grating light valve 24*a*, thereby preventing a laser beam from being applied to the recording medium 11 or the like (step S17). Then, the amount of current supplied to the laser light source 21 is gradually reduced to slowly turn off the laser light source 21 (step S18) and the initial operation ends abnormally.

The following is why the amount of current supplied to the laser light source 21 is gradually reduced to slowly turn off the laser light source 21. When a semiconductor laser is used as the laser light source 21, a sudden change in the amount of current, depending on the amount of current supplied to the laser light source 21 and electric wiring conditions, may produce a surge current and cause damage on the laser light source 21. For this reason, the image recorder according to this preferred embodiment is configured such that the light shielding mechanism 22 prevents the application of a laser beam to the recording medium 11 or the like and then the amount of current supplied to the laser light source 21 is gradually reduced to slowly turn off the laser light source 21.

However, if the laser light source 21 is one which is not affected by such a surge current, for example, the aforementioned light shielding mechanism 22 may be omitted and the laser light source 21 may be turned off immediately upon the production of an error signal.

The aforementioned steady state operation proceeds according to the process steps illustrated in FIG. 7.

First, whether or not the recording head 12 is opposed to a non-image area 19 of the recording drum 10 is determined (step S21). An image area refers to an area of the recording drum 10 an which the recording medium 11 is wound, while the non-image area 19 refers to an area not wound with the recording medium 11. This is because, since the steady state operation is executed in parallel with image recording, it is necessary for the photodetector 27 to detect the quantity of the first-order diffracted light 61 under the condition that the recording head 12 is not opposed to the image area and thus does not really record an image.

Without the recording head 12 being opposed to the image area of the recording drum 10 on which the recording medium 11 is wound, control is exerted on the grating light valve 24*a* as the light modulator 24 (step S22) and non-signal light emitted from the laser light source 21 in normal power mode is detected (step S23). The detection of the non-signal light is performed such that the photodetector 27 detects the quantity of the first-order diffracted light 61 as non-signal light which has been reflected by the total reflection prism 25*a* shown in FIG. 2 and entered the photodetector 27 located outside the lens barrel 13.

The controller 28 obtains this light quantity data (step S24) and compares it with a preset value (step S25). When the light quantity data is equal to or greater than the preset value, the grating light valve 24*a* is considered to be operating properly and a first steady state operation is completed. This steady state operation is repeated until image recording on the recording medium 11 is complete.

When the light quantity data is smaller than the preset value during the steady state operation, on the other the controller 28 judges that a malfunction occurs in the grating light valve 24*a*. Thus, an error signal is produced (step S26) and the light shielding mechanism 22 shown in FIG. 1 is activated to cut off the optical path between the laser light source 21 and the grating light valve 24*a*, thereby preventing a laser beam from being applied onto the recording medium 11 or the like (step S27). Then, the amount of current supplied to the laser light source 21 is gradually reduced to slowly turn off the laser light source 21 (step S28) and the steady state operation ends abnormally.

The image recorder with the aforementioned configuration can readily detect a malfunction in the grating light valve 24*a* as the light modulator 24. The use of the pair of total reflection prisms 25*a* and 25*b* for extracting the first-order diffracted light 61 as non-signal light from the lens barrel 13 to the outside prevents heat generation inside the leas barrel 13 and allows accurate image recording.

More specifically, if the first-order diffracted light 61 as non-signal light is cut off through the use of an aperture or the like, thermal expansion will occur in the optical system because of heat generated in the vicinity of the aperture and resultant displacement of the lenses will degrade the accuracy of image recording. To cope with such a problem, the adoption of an air-cooled mechanism for cooling the aperture will degrade the quality of recorded images because of dust particles or the like, while the adoption of a water-cooled mechanism will increase the manufacturing cost. On the other hand, the aforementioned preferred embodiment is configured such that the pair of total reflection prisms 25*a* and 25*b* are used to extract the first-order diffracted lights 61 as non-signal lights from the lens barrel 13 to the outside, which eliminates the occurrence of the aforementioned problems.

While in the aforementioned preferred embodiment, the first-order diffracted light 61 as non-signal lights are extracted at the position of the aperture stop, it may be extracted in vicinity of the aperture stop. In this case, it is impossible to extract all the first-order diffracted lights 61, but a malfunction in tho grating light valve 24*a* can still be detected through the use of the highly sensitive photodetector 27, for example.

Figure 8:
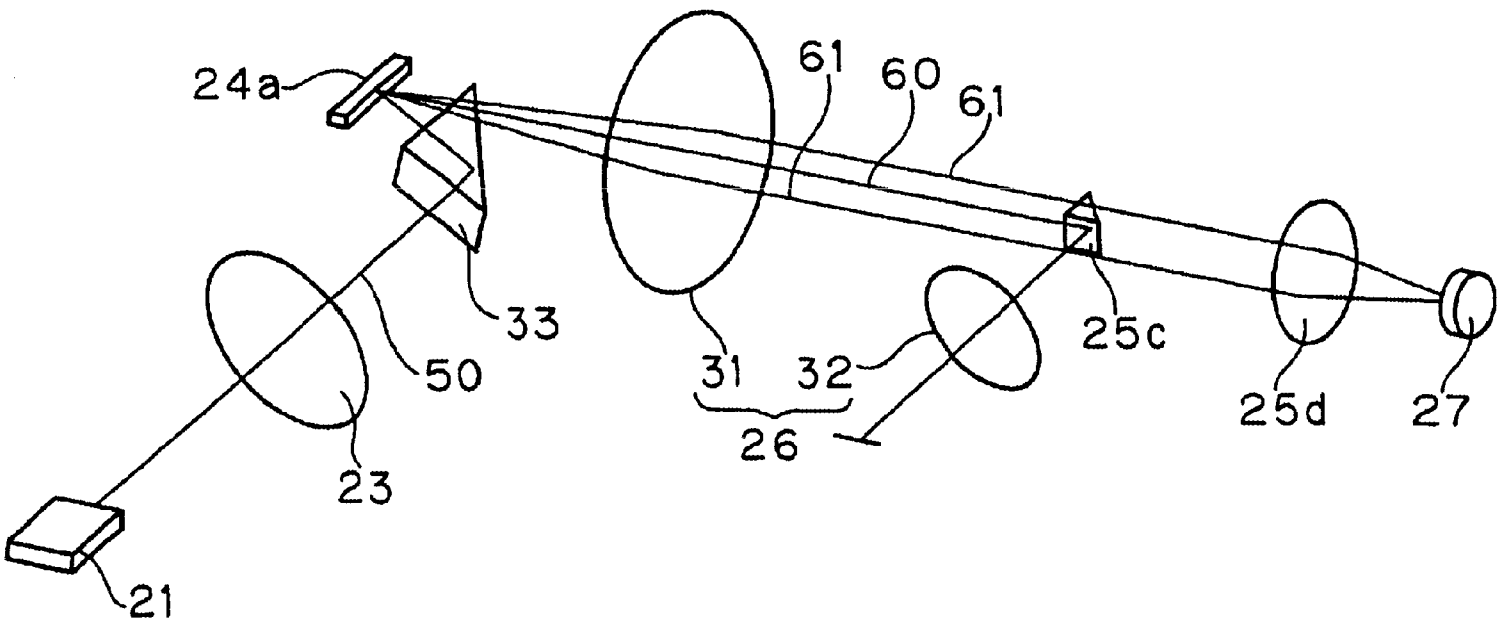
FIG. 8 is a perspective view illustrating an optical configuration of the recording head according to a second preferred embodiment.

Next, we will describe another preferred embodiment of the optical configuration of the recording head 12 in the image recorder according to the present invention. FIG. 8 is a perspective view illustrating an optical configuration of the recording head 12 according to a second preferred embodiment. In the drawing, the same references are used for members identical to those previously described in the first preferred embodiment and thus, detailed descriptions thereof will be omitted.

In the aforementioned first preferred embodiment, the first-order diffracted light 61 as non-signal light is reflected by the total reflection prism 25*a* at the position of the aperture stop for the imaging optical system 26 so as to enter the photodetector 27, while the zero-order diffracted light 60 as signal light is focused through the imaging optical system 26 onto the recording medium 11 for image formation. In this second preferred embodiment, on the other hand, the zero-order diffracted light 60 as signal light is reflected by a total reflection prism 25*c* at the position of the aperture stop for the imaging optical system 26 and focused onto the recording medium 11 for image formation, while the first-order diffracted lights 61 as non-signal lights pass through the aperture stop and enter the photodetector 27 through a condensing lens 25*d*.

More specifically, as in the first preferred embodiment, the pair of lenses 31 and 32 constituting the imaging optical system 26 are optically spaced apart from each other by a distance equal to the sum (f1+f2) of the focal lengths f1 and f2 of the lenses 31 and 32. The total reflection prism 25*c* is spaced apart from the lens 31 by the distance f1 and from the lens 32 by the distance f2, i.e., it is located at the position of the aperture stop for the imaging optical system 26 to bend the optical path for the zero-order diffracted light 60 as signal light.

With such a configuration, a malfunction in the grating light valve 24*a* as the light modulator 24 can be readily detected by executing the detecting operation shown in FIGS. 5 to 7. At this time, the use of the condensing lens 25*d* for leading the first-order diffracted lights 61 as non-signal lights from the lens barrel 13 to the outside prevents heat generation inside the lens barrel 13 and allows accurate image recording.

Further since this second preferred embodiment allows the both first-order diffracted lights 61 at different angles to enter the photodetector 27, the detection accuracy of the first-order diffracted lights 61 can be improved.

Figure 9:
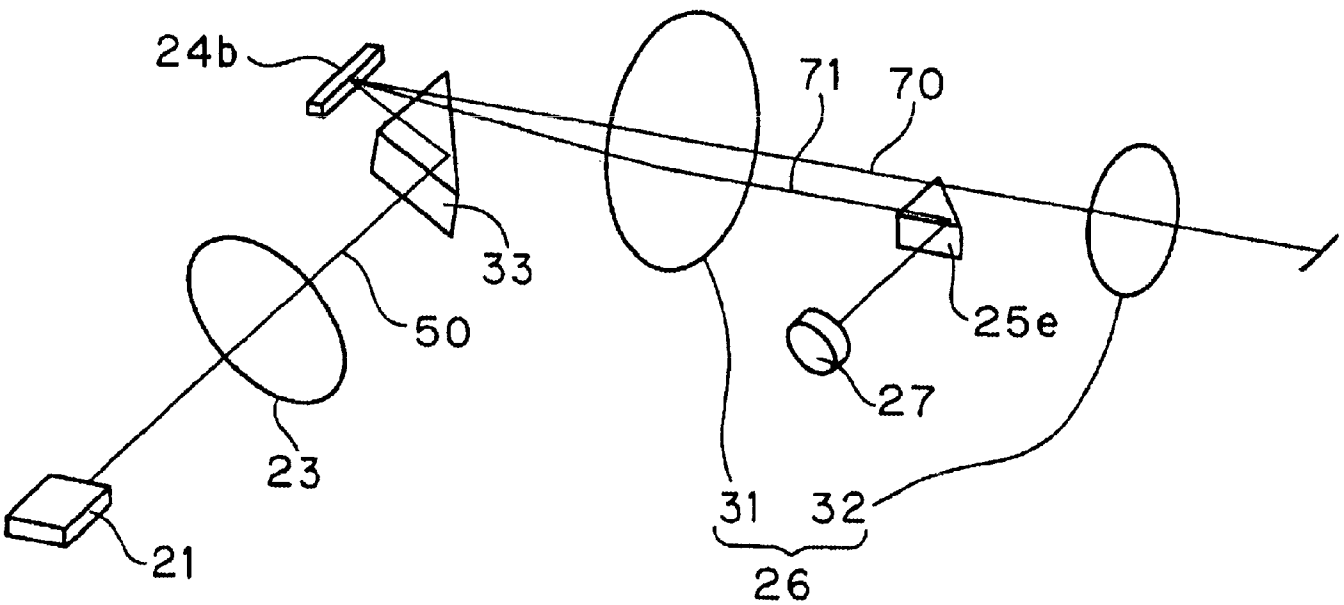
FIG. 9 is a perspective view illustrating an optical configuration of the recording head according to a third preferred embodiment.

Next, we will describe still another embodiment of the optical configuration of the recording head 12 in the image recorder according to the present invention. FIG. 9 is a perspective view illustrating an optical configuration of the recording head 12 according to a third preferred embodiment. In the drawing, the same references are used for members identical to those previously described in the first and second preferred embodiments and thus detailed descriptions thereof will be omitted.

In the aforementioned first and second preferred embodiments, the grating light valve 24*a* is used as the light modulator 24 shown in FIG. 1. The third preferred embodiment, on the other hand, uses a digital micromirror device 24*b* as the light modulator 24 shown in FIG. 1.

Figure 10A:
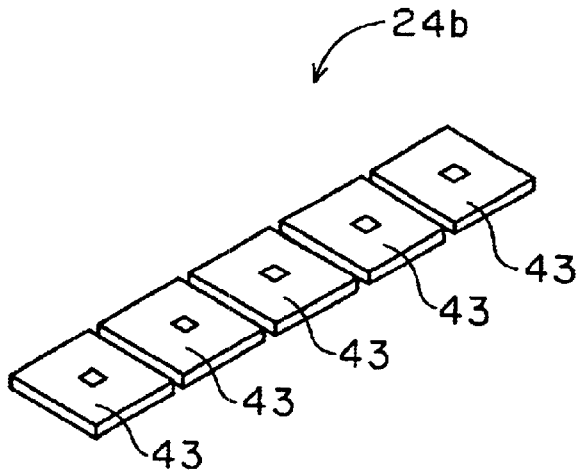
FIGS. 10A and 10B are perspective views illustrating a principal portion of a digital micromirror device.
Figure 10B:
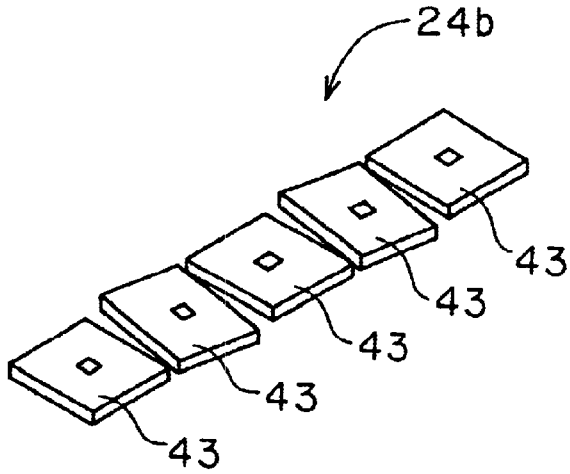

FIGS. 10A and 10B are perspective views illustrating a principal portion of such a digital micromirror device 24*b*.

The digital micromirror device 24*b* is a light modulator which modulates a light beam by electrically tilting several hundreds or several thousands of tilting micromirrors 43 relative to an axis along the diagonal of the micromirrors 43, thereby to change the direction of light beams reflecting from the micromirrors 43.

In this digital micromirror device 24*b*, with no drive signal applied to the tilting micromirrors 43, the micromirrors 43 are all in the same plane as shown in FIG. 10A. Under this condition, the digital micromirror device 24*b* serves as a totally reflecting mirror. With application of a drive signal to the tilting micromirrors 43, the tilting micromirrors 43, as shown in FIG. 10B, tilt in accordance with the drive signal and reflect a laser beam at a predetermined angle.

Thus, application of a laser beam to the digital micromirror device 24*b* produces a large number of laser beams which can be modulated independently. By using, as signal light, the light reflected from the tilting micromirrors 43 which were not tilted with no drive signal applied (this light is hereinafter referred to as "non-drive light") and as non-signal light, the light reflected from the tilting micromirrors 43 which were tilted with the application of a drive signal (this light is hereinafter referred to as "drive light"), the digital micromirror device 24*b* can be used as a light modulator for image recording.

The reason why the digital micromirror device 24*b* uses the non-drive light as signal light and the drive light as non-signal light is as follows. Since the drive light is reflected at an angle, laser beams angularly enter the recording medium 11. If decentering of the recording drum 10 or the like causes the surface of the recording medium 11 to be displaced along a direction of the optical axis of the imaging optical system 26, an area to be exposed will be displaced in the direction of drum axis alignment. Hence, if the illumination optical system 23 is located such that the optical axis of the imaging optical system 26 is parallel to the laser beams, the optical axis of the illumination optical system 23 is not perpendicular to the direction of the laser beam alignment, which makes the design of the illumination optical system 23 difficult. For such reasons, the digital micromirror device 24*b* uses the non-drive light as signal light.

In the image recorder with the aforementioned configuration, a laser beam emitted from the laser light source 21 is applied to the digital micromirror device 24*b* through the illumination optical system 23 and the total reflection prism 33. This laser beam is made into a large number of independently modulated signal lights by the digital micromirror device 24*b* and then focused through the imaging optical system 26 onto the recording medium 11 to form an image for image recording.

Referring back to FIG. 9, the recording head 12 according to the third preferred embodiment uses the pair of lenses 31 and 32 constituting a double-sided telecentric optical system, which are identical to those of the first and second preferred embodiments, as the imaging optical system 26, and a total reflection prism 25*e* located between the pair of lenses 31 and 32 as the non-signal light extraction mechanism 25 shown in FIG. 1.

The pair of lenses 31 and 32 constituting the imaging optical system 26, as in he first and second preferred embodiments, are spaced apart from each other by a distance equal to the sum (f1+f2) of the focal lengths f1 and f2 of the lenses 31 and 32. The total reflection prism 25*e* is spaced apart from the lens 31 by the distance f1 and from the lens 32 by the distance f2, i.e., it is located at the position of the aperture stop for the imaging optical system 26 to extract and lead drive light 71 as non-signal light to the outside of the lens barrel 13.

More specifically, as schematically illustrated in FIG. 9, at the position of the aperture stop for the imaging optical system 26, the optical path for non-drive light 70 as signal light is completely separated from the optical path for the drive light 71 as non-signal light. Thus, arranging the total reflection prism 25*e* in a position where the drive light 71 passes through the aperture stop allows effective extraction of the drive light 71 as non-signal light. The drive light 71 reflected by the total reflection prism 25*e* enters the photodetector 27 located outside the lens barrel 13, the photodetector 27 measuring the quantity of the drive light 71.

With such a configuration, a malfunction in the digital micromirror device 24*b* as the light modulator 24 can be readily detected by executing the detecting operation shown in FIGS. 5 to 7. The use of the total reflection prism 25*e* for leading the drive light 71 as non-signal light from the lens barrel 13 to the outside prevents heat generation inside the lens barrel 13 and allows accurate image recording.

Figure 11:
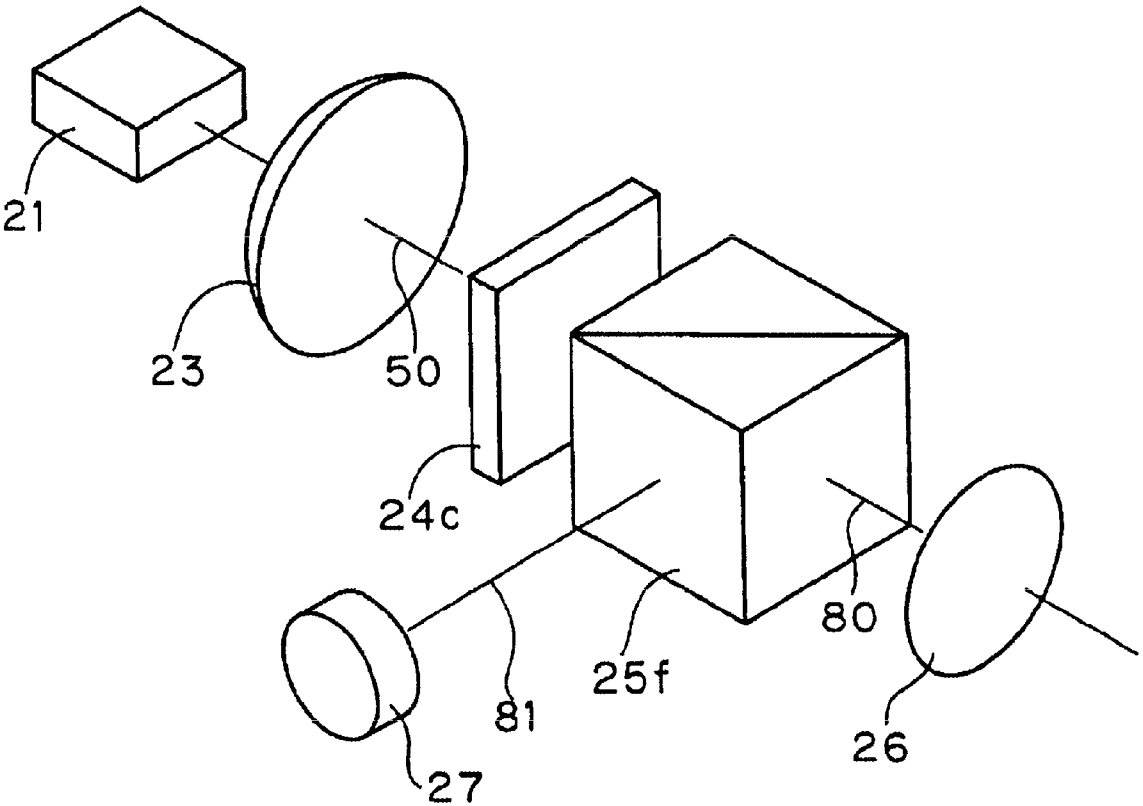
FIG. 11 is a perspective view illustrating an optical configuration of the recording head according to a fourth preferred embodiment.

Next, we will describe still another preferred embodiment of the optical configuration of the recording head 12 in the image recorder according to the present invention. FIG. 11 is a perspective view illustrating an optical configuration of the recording head 12 according to a fourth preferred embodiment. In the drawing, the same references are used for members identical to those previously described in the first through third preferred embodiments and thus, detailed descriptions thereof will be omitted.

The aforementioned first and second preferred embodiments use the grating light valve 24*a* and the aforementioned third preferred embodiment uses the digital micromirror device 24*b* as the light modulator 24 shown in FIG. 1. In the fourth preferred embodiment, on the other hand, a PLZT (lead lanthanum zirconate titanate) light modulator 24*c* is used as the light modulator 24 shown in FIG. 1.

The PLZT light modulator 24*c* has the function of rotating the polarization state of a laser beam in accordance with a voltage applied thereto and it is used in combination with a polarized beam splitter 25*f*.

In the image recorder according to the fourth preferred embodiment, a laser beam emitted from the laser light source 21 is applied to the PLZT light modulator 24*c* trough the illumination optical system 23. When a drive signal is applied to the PLZT light modulator 24*c*, the polarization state of the laser beam (the direction of an electric vector) is rotated at a right angle. With no drive signal applied to the PLZT light modulator 24*c*, the laser beam enters the polarized beam splitter 25*f* without the rotation of the polarization state.

The laser beam whose polarization state has not been rotated with no drive signal applied to the PLZT light modulator 24*c* just passes through the polarized beam splitter 25*f* and, after entering the imaging optical system 26 as signal light 80, it is focused onto the recording medium 11 to form an image for image recording.

On the other hand, the laser beam whose polarization state has been rotated at a right angle with the application of a drive signal to the PLZT light modulator 24*c* changes its direction at a right angle at the polarized beam splitter 25*f* and enters the photodetector 27 located outside the lens barrel 13 as non-signal light 81, the photodetector 27 measuring the quantity of the non-signal light 81.

With such a configuration, a malfunction in the PLZT light modulator 24*c* as the light modulator 24 can readily detected by executing the detecting operation shown in FIGS. 5 to 7. The use of the polarized beam splitter 25*f* for extracting the non-signal light 81 from the lens barrel 13 to the outside prevents heat generation inside the lens barrel, 13 and allows accurate image recording.

While the invention has been shown and described in detail, the foregoing description is in all aspects illustrative and not restrictive. It is therefore understood that numerous modifications and variations can be devised without departing from the scope of the invention.

What is claimed is:

1. An image recorder for forming an image onto an image recording surface, comprising:

a laser light source for emitting a laser beam;

an illumination optical system for irradiating a light modulator with said laser beam, wherein said light modulator modulates the laser beam and forms signal light when no drive state is applied to said light modulator and forms non-signal light when a drive signal is applied to said light modulator;

an imaging optical system for focusing said signal light onto said image recording surface to form an image;

a photodetector for detecting said non-signal light; and a detector for detecting a malfunction in said light modulator on the basis of output from said photodetector.

2. The image recorder according to claim 1, further comprising: a controller for exercising predetermined control when said detector detects a malfunction in said light modulator.

3. The image recorder according to claim 2, further comprising: a light shielding mechanism for, when said detector detects a malfunction in said light modulator, cutting off an optical path between said laser light source and said image recording surface under the control of said controller.

4. The image recorder according to claim 3, wherein said light modulator is a reflective light modulator serving as a regular reflecting minor with no drive signal applied.

5. The image recorder according to claim 4, wherein said reflective light modulator is a grating light valve.

6. The image recorder according to claim 5, further comprising: a non-signal light extractor for, at an aperture stop for said imaging optical system, leading said non-signal light to said photodetector located outside said imaging optical system.

7. The image recorder according to claim 6, wherein said detector detects a malfunction in said light modulator during at least either an initial operation performed prior to image recording or a steady state operation performed during image recording.

8. The image recorder according to claim 5, wherein said imaging optical system comprises: a reflecting member for bending an optical path for said signal light at an aperture stop for said optical system; and a condenser for focusing said non-signal light into said photodetector.

9. The image recorder according to claim 7, wherein said detector detects a malfunction in said light modulator during at least either an initial operation performed prior to image recording or a steady state operation performed during image recording.

10. The image recorder according to claim 4, wherein said reflective light modulator is a digital micromirror device.

11. The image recorder according to clam 3, wherein said light modulator is a PLZT light modulator.

12. The image recorder according to claim 2, further comprising: a stop mechanism for, when said detector detects a malfunction in said light modulator, stopping the operation of said laser light source under the control of said controller.

13. The image recorder according to claim 12, wherein said light modulator is a reflective light modulator serving as a regular reflecting mirror with no drive signal applied.

14. The image recorder according to claim 13, wherein said reflective light modulator is a grating light valve.

15. The image recorder according to claim 14, further comprising: a non-signal light extractor for, at an aperture stop for said imaging optical system, leading said non-signal light to said photodetector located outside said imaging optical system.

16. The image recorder according to claim 15, wherein said detector detects a malfunction in said light modulator during at least either an initial operation performed prior to age recording or a steady state operation performed during image recording.

17. The image recorder according to claim 14, wherein said imaging optical system comprises: a reflecting member for bending an optical path for said signal light at an aperture stop for said imaging optical system; and a condenser for focusing said non-signal light into said photodetector.

18. The image recorder according to claim 17, wherein said detector detects a malfunction in said light modulator during at least either an initial operation performed prior to image recording or a steady state operation performed during image recording.

* * * * *